US007461428B2

(12) United States Patent
Nowak

(10) Patent No.: US 7,461,428 B2
(45) Date of Patent: Dec. 9, 2008

(54) FLOOR CLEANING MACHINE

(75) Inventor: Harald Nowak, Goltoft (DE)

(73) Assignee: Hako-Werke GmbH, Bad Oldesloe (DE)

( * ) Notice: Subject to any disclaimer, the term of this patent is extended or adjusted under 35 U.S.C. 154(b) by 651 days.

(21) Appl. No.: 10/942,443

(22) Filed: Sep. 15, 2004

(65) Prior Publication Data

US 2005/0055786 A1 Mar. 17, 2005

(30) Foreign Application Priority Data

Sep. 15, 2003 (DE) ..... 103 42 455

(51) Int. Cl.
*E01H 1/04* (2006.01)

(52) U.S. Cl. ..... 15/83; 15/49.1; 15/85

(58) Field of Classification Search ..... 15/83, 15/85, 49.1, 52.1; 414/407, 414, 421; 298/22 R, 298/22 P See application file for complete search history.

(56) References Cited

U.S. PATENT DOCUMENTS 4,178,647 A * 12/1979 Wolynec et al. ..... 15/84
5,027,464 A * 7/1991 Knowlton ..... 15/83
5,377,376 A * 1/1995 Wood et al. ..... 15/83

* cited by examiner

*Primary Examiner*—Laura C Guidotti
(74) *Attorney, Agent, or Firm*—Wildman, Harrold, Allen & Dixon LLP

(57) ABSTRACT

A floor cleaning machine includes a driven brush for sweeping debris and dirt into a dirt container which is supported by a retracting arm actuated by a powered actuator, such as an hydraulic cylinder, between a use position in which said dirt container is sealed to a dirt discharge opening to collect all the dirt, and a raised, dumping position. Between the use position and the dumping position, the dirt container is maintained in the same disposition to avoid inadvertent spillage of its contents, by the cooperation of an articulating linkage which includes an auxiliary arm. The auxiliary arm is releaseably fixed to the machine by a latch to maintain the desired disposition of the dirt container while raising the container. When the dirt container is raised to the dumping position, and the latch is released, the dirt container pivots to dump its contents. A stop device limits the rotation of the dirt container such that when the dirt container is returned, after dumping, to the normal use position, the latch is automatically re-secured.

13 Claims, 11 Drawing Sheets

FLOOR CLEANING MACHINE

RELATED APPLICATION

This application claims the benefit of the filing of German Application No. 103 42 455.5, filed Sep. 15, 2003, for "Floor Cleaning Machine".

FIELD OF THE INVENTION

This invention relates to a floor-cleaning machine that can be driven over the floor to be cleaned, with a driven, rotating cleaning brush that can be brought into contact with the floor for sweeping dirt and debris into a rear-mounted dirt container which is carried by a boom or retracting arm.

BACKGROUND OF THE INVENTION

Typically, in sweeping machines of this type, the dirt container may be placed under operator control, either in an operating position, where the edge of its inlet opening is in sealed engagement with the edge of the discharge opening of the dirt delivery conduit, or in a raised position, from which the dirt container may be rotated under operator control into a dumping position to empty its contents.

Such floor-cleaning machines are known in various forms. For example, in some cases, a driven rotating brush, usually in the form of a cylinder sweeping brush is extended transverse to the central longitudinal (i.e. extending along the direction of travel) axis of the sweeping machine. The brush is driven to throw dirt picked up from the floor along a dirt-conducting channel and through a dirt delivery or discharge opening into the dirt container, usually in the form of a tub or large bucket. In the operating or sweeping position, the dirt container is located at the outer side of the dirt discharge opening with its opening edge tightly engaged (i.e. sealed) so that all of the dirt picked up from the floor is delivered into the container. The dirt container is arranged on at least one retracting arm (typically, on a pair of side arms) which, together with a parallel arm, forms a parallelogram lift assembly. In order to empty the dirt container, the lift arms are swiveled upwards by means of an hydraulic cylinder unit (or an electric linear actuator) so that the dirt container is moved into a raised position for dumping. During this lift motion the dirt container is maintained in a generally upright alignment by the parallelogram rod assembly to avoid spilling. With the dirt container in the raised position, the operator can drive the floor-cleaning machine to a place where the dirt container is moved above a large garbage container, into which the contents of the dirt container may be emptied by dumping.

In order to empty the contents of the dirt container in these existing designs, the operator manually loosens a holding device that rigidly connects the dirt container with the parallelogram rod assembly to prevent unintended rotation of the dirt container. When the holding device is loosened, the dirt container rotates, usually under gravity, around its mounting pivots at the distal end of the retracting arm so that the contents of the container are emptied into a larger refuse container for disposing.

After emptying the dirt container, it is necessary in these earlier machines, to manually return the dirt container to its initial use position in relation to the parallelogram rod assembly and manually to re-engage a holding device which secures the dirt container. However, it is also known to arrange (on the side of the dirt container) a hydraulic cylinder unit or an electric linear drive which, upon actuation, returns the dirt container from its emptying position into the usual alignment in relation to the parallelogram rod assembly so that the holding device can then be re-engaged.

Thus, in the known technical solutions one has had to perform manually the operation of returning the dirt container from its raised emptying position to the lowered use position, for which purpose the operator had to climb down from the floor-cleaning machine and manually rotate the dirt container, requiring considerable force or by using a supplemental power drive for rotating the dirt container from the emptying position to the normal collection or use position.

SUMMARY OF THE INVENTION

An object of the instant invention is to provide an improved floor-cleaning machines in such a manner that the return of the dirt container from its emptying position to the sealed use position occurs automatically from the operator's position and without the need for a separate power drive or manual unlocking of the dirt container.

In order to accomplish this, the invention is designed as a floor-cleaning machine of the sweeping type, but in such a manner that a releasable retaining connection (i.e. a latch) is provided at the connection of the parallel arm of an articulated linkage to an auxiliary arm of the articulated linkage. While the dirt container is raised from the use position to the dumping position the latch is engaged so that the parallel arm of the articulated linkage and the retracting arm of the machine act as a parallelogram to maintain the desired disposition of the dirt container. After reaching the high dump position, the latch is disengaged by the operator from the operator's position; and the dirt container rotates to dump the contents. After the contents are dumped, the container may be lowered. During this phase, the dirt container is limited in rotation in relation to the retracting arm in order to re-establish the retaining connection of the latch. After the retaining connection is re-established so that the distal end of the articulated link is fixed relative to the machine, yet able to pivot, the dirt container is secured in the desired position for normal, sealed use.

Thus, in the floor-cleaning machine according to the invention, the dirt container—when it is in the raised emptying position—during the lowering of the retracting arm, is supported by the retracting arm and is placed in the emptying or discharge position. As a result, the mounting point of the parallel arm on the dirt container is moved along a path in which the proximal end of the parallel arm is displaced in the direction towards the fixed attachment point on the machine. This movement continues until the retaining connection is re-established. When this occurs, the dirt container is in an alignment that corresponds to its normal operating position, and is now held in this position by the reinstated parallelogram linkage, while the lowering of the retracting arm continues. In order to enable the pivoting movement of the container to the use position, the support of the dirt container is automatically established so that the parallelogram linkage can once again swing the dirt container into the operating position, in which the mouth of the dirt container seals against the opening edge of the dirt discharge conduit.

A particularly advantageous solution of effecting the control and support of the dirt container resides in a design that provides a spring and a limit-stop surface, whose support effect is negated by its deformation due to the growing force of the lowering parallelogram assembly. This spring, which can be, for example, a leaf spring attached to the dirt container, and which exerts its action together with a stopping surface provided on the retracting arm, holds the dirt container in its emptying position until the latch connection of the articulated linkage is re-established, i.e., the spring exerts a support action necessary to overcome the resistance that acts against the return of the parallelogram rod assembly and the re-establishment of the latch connection. Once the latch connection is re-established and the parallelogram rod assembly (that has thus become effective) exerts a force sufficient to rotate the dirt container, the spring is deformed and no longer prevents the dirt container from returning to its operation position.

For the support of the dirt container, it is also possible to provide, for example, a solid stop limit that engages in a supporting position with a first guide surface and, during the lowering of the retracting arm, displaces itself along this surface so that, in this way, the parallelogram rod assembly is displaced accordingly and the holding or latch connection is re-established. When this occurs, the limit stop is released from the first guide surface, thus enabling the return pivoting of the dirt container to its sealed operating position effected by the parallelogram assembly.

Thus, the first guide surface is preferably provided on the dirt container and the solid limit stop is built on a fixed point of the machine frame. Furthermore, so that the dirt container does not overshoot, the first guide surface can be followed by a second guide surface that limits the swiveling of the dirt container at the release of the solid limit stop from the first guide surface.

The release of the holding connection can be effected in that the internal end of the parallel arm is released from the fixed point on the machine. In order to hold this internal end in a defined position when the holding position is released, and especially in order to return it during the lowering of the retracting arm to a position that enables the holding connection to be re-established, the internal end of the parallel arm may be conducted in a guide slot. However, in an advantageous design, the inner end of the parallel arm is connected, in a pivoting fashion, with the upper end of an auxiliary arm whose lower end is connected, again in a pivoting manner, with the floor-cleaning machine. When the retaining connection (i.e. latch) is established, the auxiliary arm is held firmly so that its connection with the parallel arm forms the fixed point on the machine, while the auxiliary arm can be released from this fixed position in order to allow for the release for example, by a latch, which the operator can move into a release position in order to release the retaining connection and thus effect the rotation of the dirt container into its emptying position.

If, due to the lowering of the retracting arm, the proximal end of the parallel arm is displaced and thus the auxiliary arm is swiveled back in the direction toward its fixed position, the retaining position can be automatically established by engaging the latch. For this purpose, during an existing retaining connection, the latch can be in a positive connection with a surface provided on the auxiliary arm.

Other features and advantages of the present invention will be apparent to persons skilled in the art from the following detailed description, accompanied by the attached drawings, wherein identical reference numerals will refer to like parts in the various views.

DETAILED DESCRIPTION OF THE ILLUSTRATED EMBODIMENTS

Figure 1:
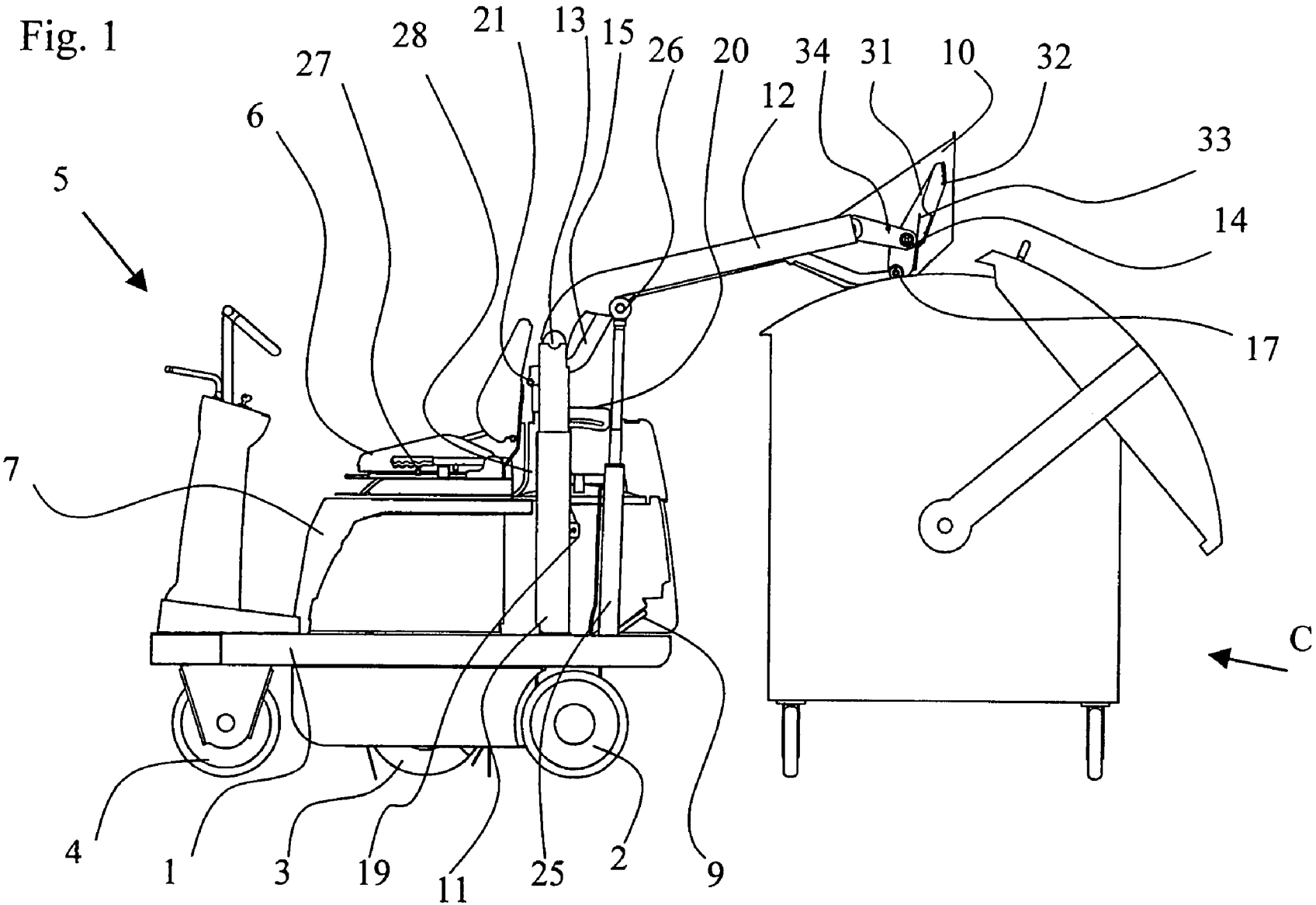
FIG. 1 is a schematic left side view of a floor-cleaning machine with the dirt container raised in a position above a garbage container.

The floor-cleaning machine shown in FIGS. 1 to 8 has a conventional design with a frame or chassis 1, on which are arranged rear wheels, one of which is seen at 2 in the drawing, and a central front wheel 4. On the chassis 1 is provided a driver area 5 that comprises a driver seat 6 and various conventional operation and control elements used for the operation of the floor-cleaning machine. During the machine's operation, a driven rotating sweeping brush 3 in cylindrical form is brought into contact with the floor to be cleaned. In FIG. 1, the brush 3 rotates clockwise so that it hurls the collected dirt upwards in an overhead motion. This dirt and debris is then conducted, in a conventional fashion, between a guide metal sheet and the outer circumference of the sweeping brush 3 upwards into a dirt conduit and, from there it arrives, supported by a suction pressure, through a dirt discharge opening—which has a peripheral edge provided with a sealing gasket 9 located about the discharge opening of the dirt conduit and in sealing engagement with the inlet opening of dirt container 10. The dirt container 10 is conventional, having a flat bottom, inclined forward and rear walls and upright left and side walls forming an open top container in the general form of a tub. During normal cleaning operation, the dirt container 10 (which is described further below) is in the operation position shown in FIG. 8 with the edge of its inlet opening resting firmly against sealing gasket 9 so that the dirt enters the dirt container 10 through the dirt delivery opening of the machine, under suction assist, as is known.

By way of further background, as persons skilled in the art know, the dirt conduit (not illustrated in the drawing) ends at a bottom entrance aperture of an air-conduit housing that contains a filter device, above which is provided a removable cover. This superstructure, including a suction fan provided in the side wall of the air-conduit housing, is described in the German patent application 103 24 825.4.

On the chassis 1 is mounted a housing 7, which provides space for an internal-combustion engine which drives, among other elements, the fan, the suction sweeping brush 3, and a hydraulic motor used to power the machine.

The illustrated floor-cleaning machine differs from the former floor-cleaning machines in the operation and control of the dirt container.

The illustrated floor-cleaning machine comprises a tub-shaped dirt container 10, as is common in this type of floor-cleaning machine, which is held on one side by a parallelogram rod assembly attached to the outer left (i.e. relative to the forward direction of travel) side wall of the dirt container. On the far side of the dirt container 10 is engaged a retracting arm as it is described subsequently as a part of the parallelogram rod assembly.

The parallelogram rod assembly includes a retracting arm or boom 12 that is pivotally mounted at its forward or proximal end at 13 to the upper end of a supporting column 11 mounted to the chassis or frame 1. This supporting column 11 is shown in a fragmentary fashion in order to fully illustrate the functioning of the parallelogram rod assembly. The upper end of the supporting column 11 of the retracting arm may be located on the right side of the machine, behind the driver.

The outer or distal end of the retracting arm 12 is pivotally connected at 14 to the side wall of the dirt container 10. In this connection on the side wall of the dirt container, a plate 31 is attached, which carries a limit stop 32 (the function of which is described below) made of elastically deformable synthetic material or rubber and a leaf spring 33 (also to be described below).

A hydraulic cylinder unit 25, has its butt end pivotally mounted to the chassis 1, and its rod end is pivotally mounted at 26 to the bottom of the retracting arm or boom 12. When the hydraulic cylinder is extended, the retracting arm 12 is raised from the normal operating position of the dirt container 10 (FIG. 8) to the dumping position of FIG. 1. The hydraulic cylinder 25 may be single or double-acting, as persons skilled in the art know, and it forms with support columns 11, a four-bar actuating linkage for raising the retracting arm 12.

As another element of the parallelogram rod actuating assembly, an arm 15, referred to as a parallel arm, is mounted with its distal end pivotally connected to the side wall of dirt container 10 at 17 underneath the pivot mounting 14 of the distal end of the retracting arm 12. The proximal end of the parallel arm 15 is pivotally connected at 16 to the upper end of an auxiliary arm 18. The auxiliary arm 18 is generally upright, with its lower end pivotally mounted in a fixed point 19 (FIG. 3) on the housing or frame of the machine. The auxiliary arm 18 includes a laterally extending guide pin designated 18A in FIG. 2, which is received in a guide slot 20A (FIG. 3) in a guiding metal sheet 20 that is firmly attached to the housing so that the guide pin, during the pivoting motion of the auxiliary arm 18 (to be described) is conducted into the guide slot and supports the auxiliary arm 18. The auxiliary arm 18 and parallel arm 15, together with pivot 16, form an articulated link, which functions in two distinct manners, depending on whether the pivot 16 is fixed (the retention position) or permitted to move, as will now be described.

The auxiliary arm 18 carries, at its upper end, a protrusion or extension 21 (FIG. 6) that, in the operation position of the dirt container (FIG. 8) engages a retracted latch 30 (FIG. 6) that rests on a latch housing 29 mounted to the machine. The latch 30 may be retracted within housing 29 by means of an actuation lever 27 that is located adjacent the driver's seat 6 and which can be operated by a sitting driver—i.e.—pulled down, by means of a control cable 28, against the force of a spring (in housing 29) from the locked position of FIG. 6 in order to release the protrusion 21 and thus free the auxiliary arm 18 and permit it to rotate about the base pivot connection 19.

Figure 6:
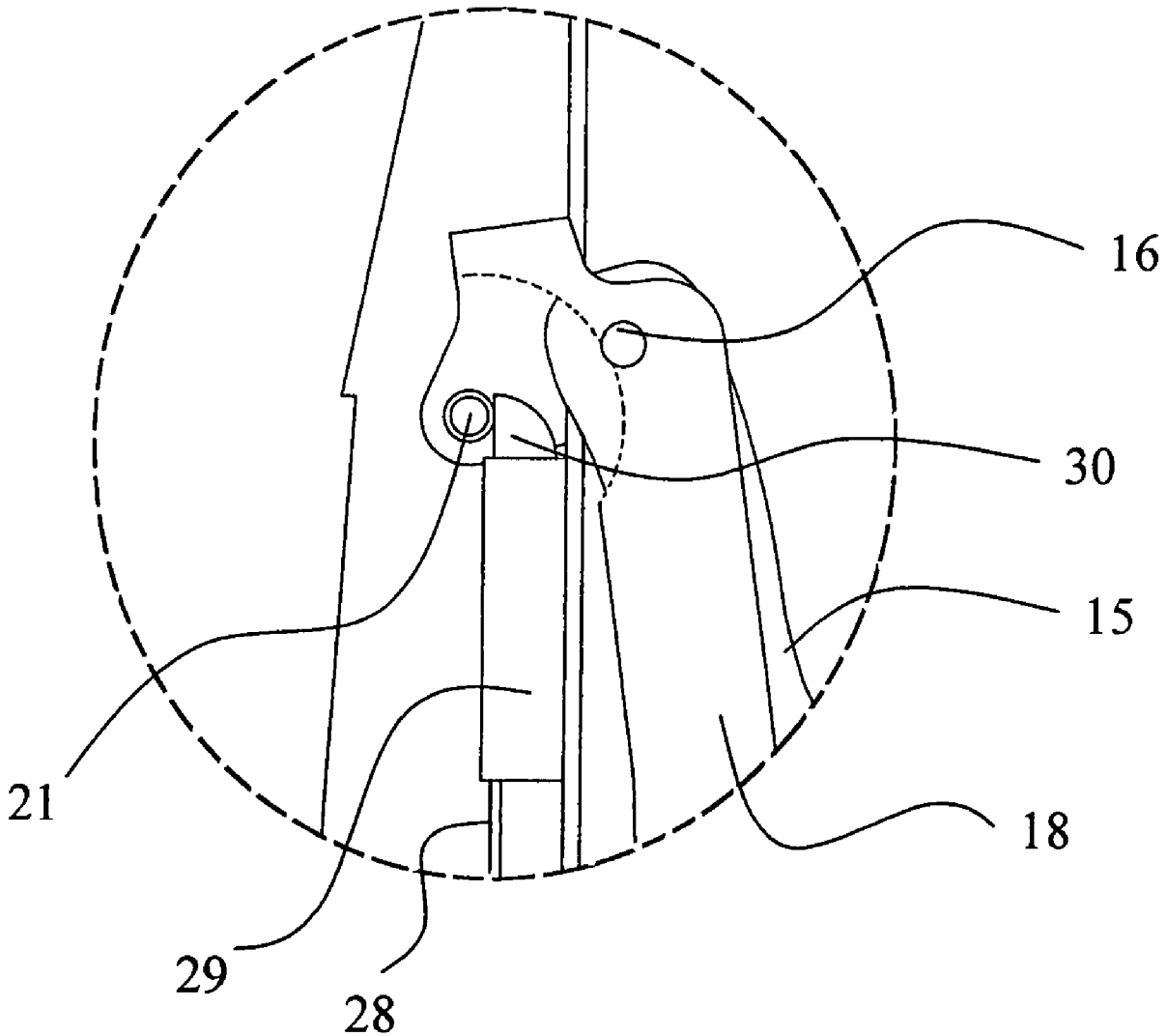
FIG. 6 is an enlarged, fragmentary view illustrating the engagement of the latch with the auxiliary arm establishing the retaining connection of the articulated linkage;.
Figure 7:
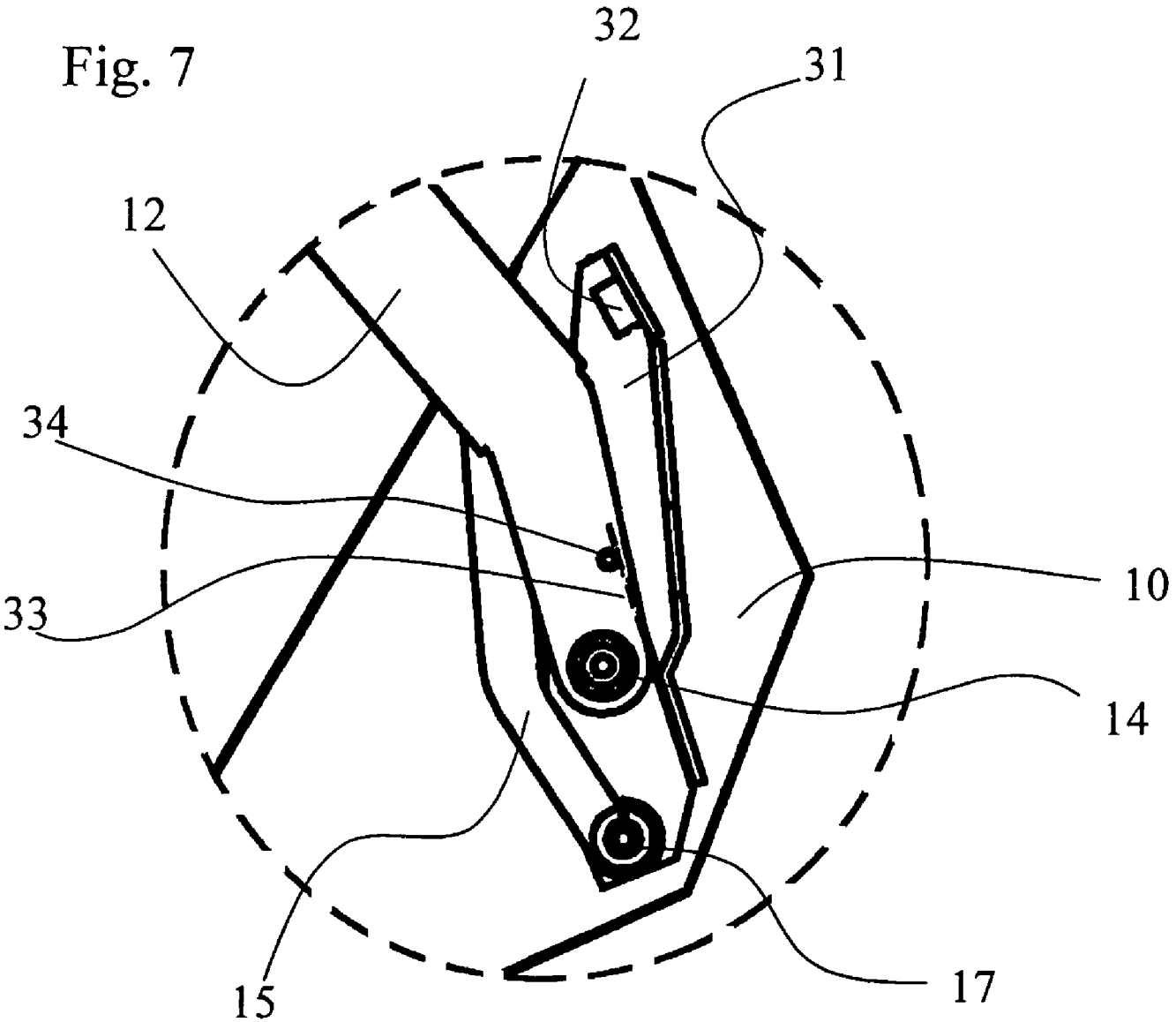
FIG. 7 is in an enlarged fragmentary side view illustrating the arrangement of a spring and a limit stop used to support the dirt container.
Figure 8:
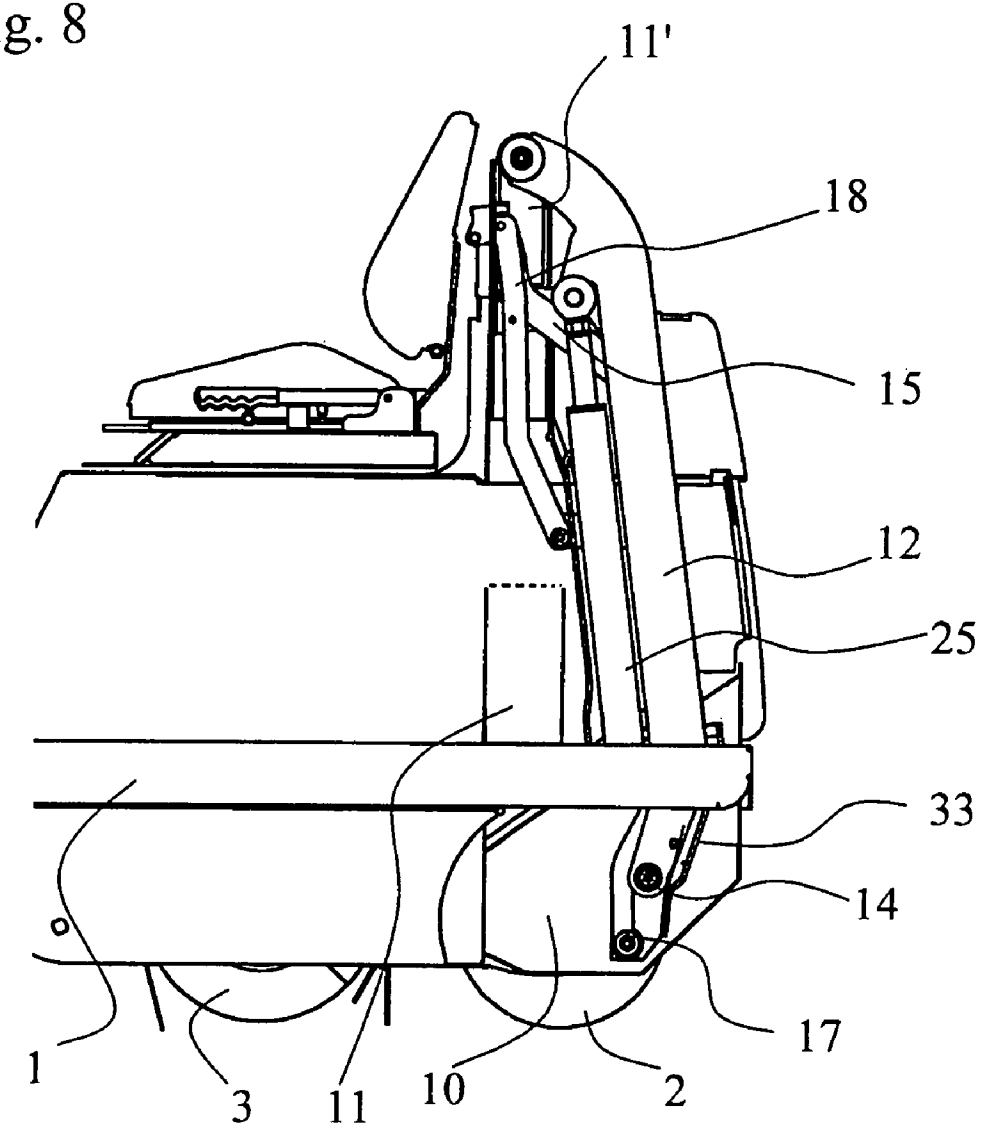
FIG. 8 is a fragmentary side view of the floor-cleaning machine of FIG. 1 in a representation corresponding to FIG. 5, with the dirt container in its normal operating position.

As will be apparent, with the auxiliary arm 18 in the locked position of FIG. 6, the retracting arm 12 and the parallel arm 15 act as a four-bar linkage (or parallelogram rod assembly) so that the retracting arm 12—when pivoted by the extension or retraction of the hydraulic cylinder 25, keeps the dirt container 10 in the same general upright (non-spilling) disposition seen in FIG. 1, in which the inlet opening of the dirt container 10 is inclined at the same angle as the seal 9 adjacent the dirt deliver opening leading into container 10 in the use position of FIG. 8.

FIG. 1 shows the floor-cleaning machine in a state in which the retracting arm 12 of the parallelogram rod assembly is pivoted to a raised position, and the dirt container 10 is located above a large garbage container C, into which the contents of the dirt container 10 is to be emptied. In this position, the parallelogram rod assembly is functioning in its parallelogram linkage state—i.e., the auxiliary arm 18 is held by the latch 30 in a fixed position, anchored to the machine; and therefore, the proximal or forward end of the parallel arm 15 of the parallelogram rod assembly is fixed to the machine. This is sometimes referred to as a holding connection or releasable connection between the pivot 16 of the parallel arm 15 and the machine. This means there is a fixed distance between the machine frame and the pivot point 17 at the distal end of the parallel arm 15.

Figure 2:
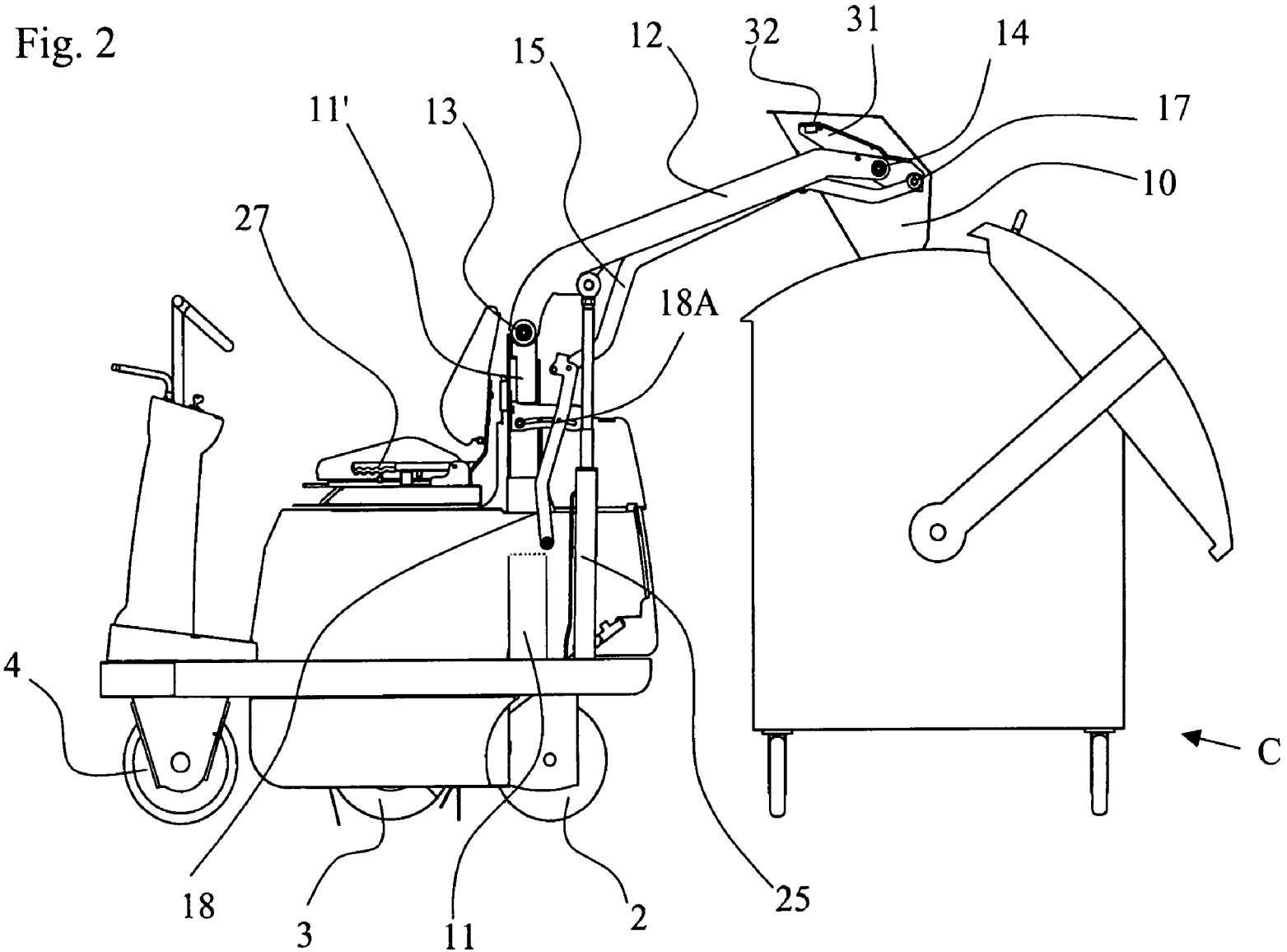
FIG. 2 shows the floor-cleaning machine of FIG. 1 with the dirt container rotated to the emptying position, with some components eliminated to better illustrate the operation of the parallelogram assembly.
Figure 3:
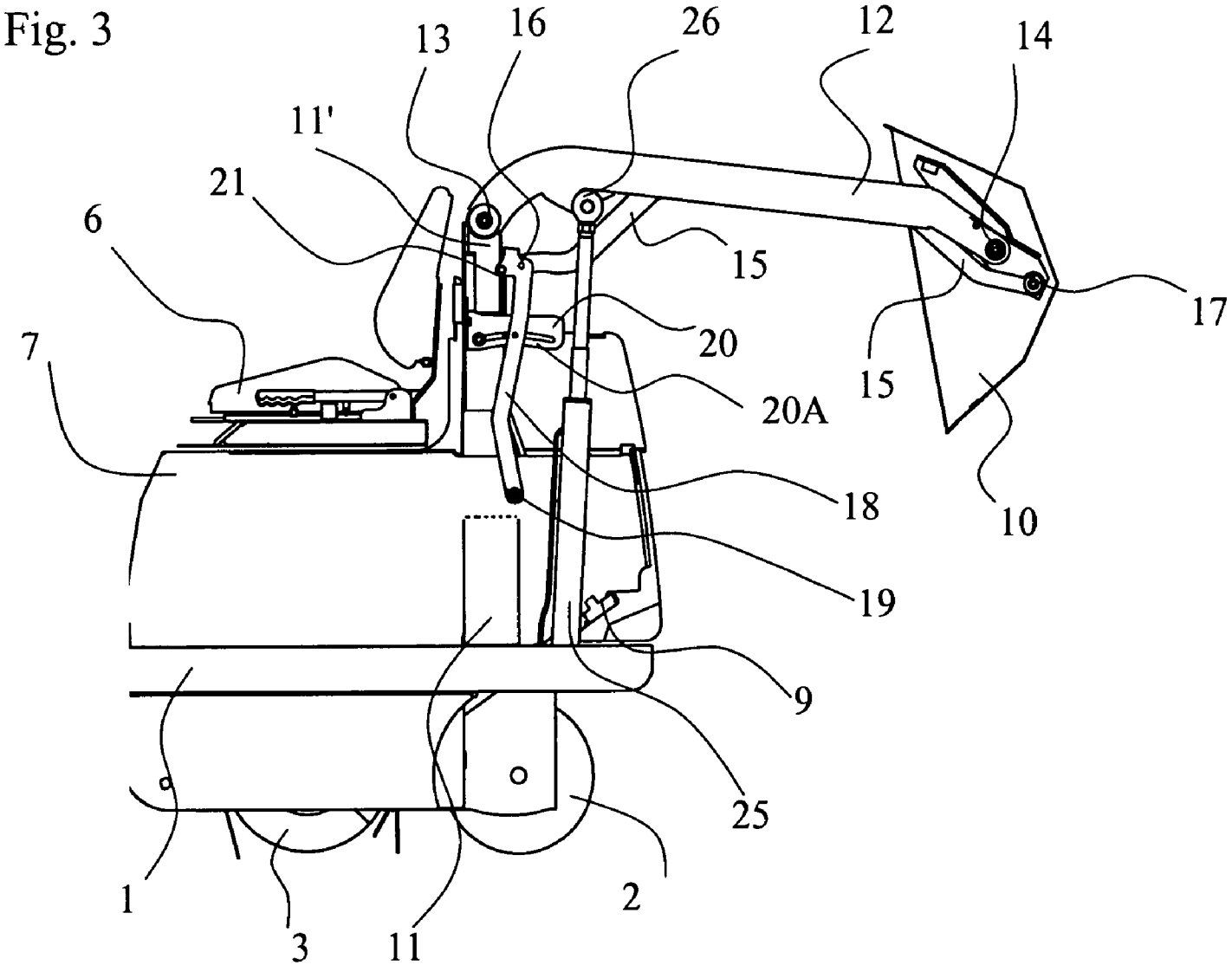
FIG. 3 is a fragmentary left side view of the floor-cleaning machine of FIG. 2 with the hydraulic cylinder retracted slightly.

In order to empty the dirt container 10 from the position of FIG. 1, the operator swivels the actuation lever 27 and thus pulls down, by means of the control cable 28, the latch 30 so that the protrusion 21 of the auxiliary arm 18 is released and the auxiliary arm 18 is free to pivot. Thus, parallel arm 15 is free to move and no longer supports the dirt container 10. Due to the position of the center of gravity of the dirt container 10, the dirt container swivels counterclockwise around the pivot 14 into the emptying position as shown in FIG. 2 so that the contents are emptied under gravity into the container C. During this swiveling motion of the dirt container 10, the pivot 17 of the parallel arm 15 moves in an arc-like motion around the mounting pivot 14 of the retracting arm 12; and the pivot connection 16 of the parallel arm 15, together with a pivot or swinging motion of the auxiliary arm 18, is displaced—as is shown in FIG. 2—around its mounting point 19 clockwise and to the rear (or right side in the drawing).

When the auxiliary arm 18 is released, the dirt container 10—due to its inertia—(and especially, when it is full) may overshoot the emptying position shown in FIG. 2 in a counterclockwise direction with the corresponding elastic deformation of a leaf spring 33, thereby creating a bias force tending to return the dirt container to its desired orientation. However, the overshoot condition is prevented by a limit stop 32 mounted on the dirt container 10, which limits the pivot motion of the dirt container 10 by engaging and limiting the motion of the retracting arm 12 (see FIG. 4).

After a second raising of the dirt container (to insure the dumping of all contents), the floor-cleaning machine is driven away from container C so that the dirt container 10 is removed therefrom; and then the retracting arm 12 is lowered by retracting the cylinder unit 25. As is clear from a comparison of FIGS. 3 and 4, which show this lowering process, this first results in a certain rotation of the dirt container 10 counterclockwise in relation to the distal end of the retracting arm 12 that is being lowered, wherein, in these figures, the proximal end of the parallel arm 15 is moved even further to the rear—toward the dirt container 10. Due to this swinging motion of the dirt container 10, the leaf spring 33 attached to the plate 31 engages a protrusion 34 on the front end of the retracting arm 12 that forms a stop or limit surface (as may be seen in FIG. 7) and prevents the dirt container 10 from further rotation about pivot 14 during a further lowering motion of the retracting arm 12.

Figure 5:
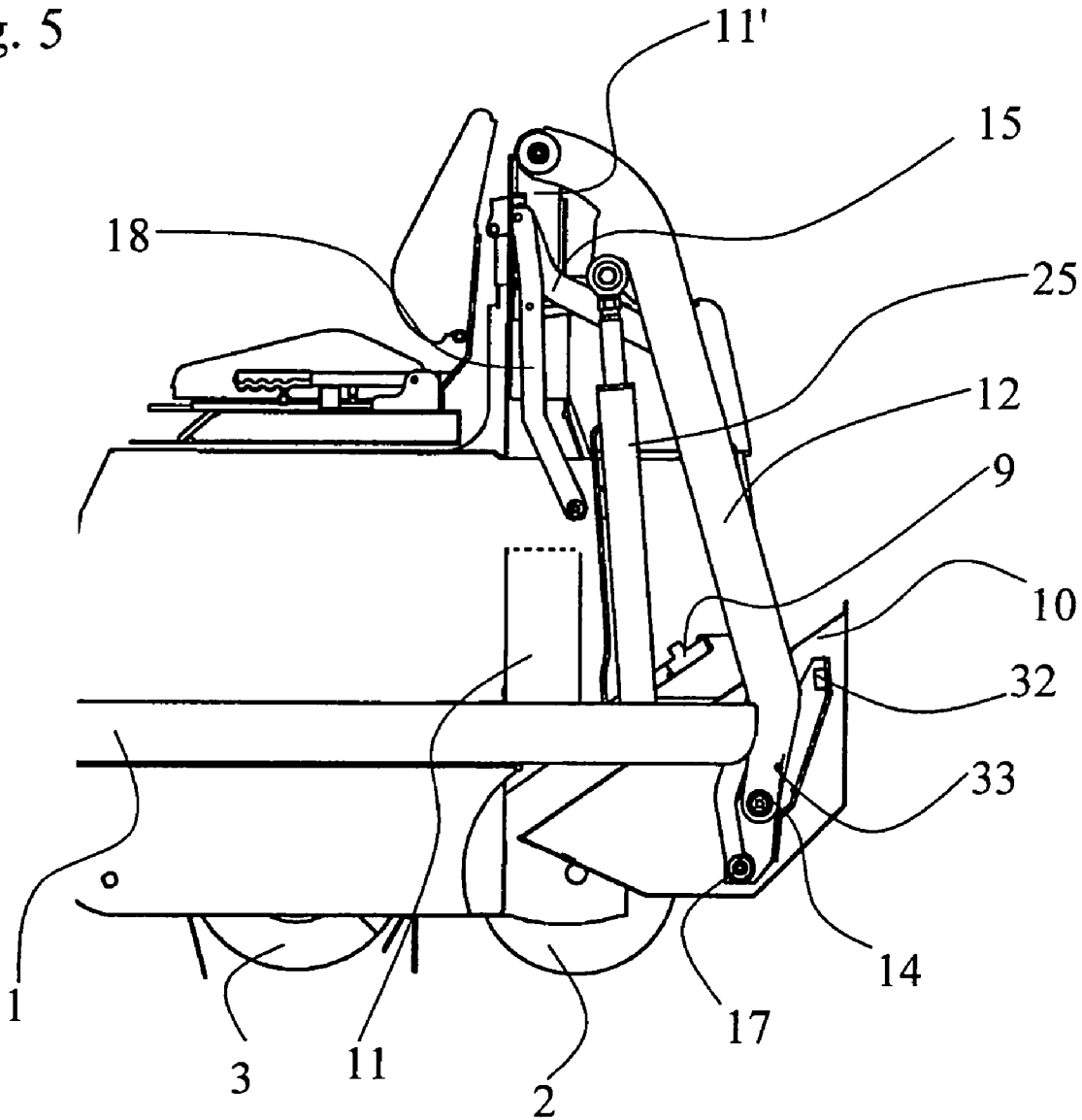
FIG. 5 is a fragmentary left side view of the inventive floor-cleaning machine with the retaining connection of the articulating linkage established.

Due to the supporting and limiting effect of the leaf spring 33 on the retracting arm 12, the mounting point 17 of the outer end of the parallel arm 15 can no longer travel counterclockwise around the pivot mounting 14 during the further lowering of the retracting arm 12. Rather, the inner end of the parallel arm 15 is instead displaced further to the left, and thus the upper end of the auxiliary arm 18 moves toward the latch 30 until the protrusion 21 passes the latch 30, overcoming the spring bias force and, by engaging the catch 30, reaches a locked position (see FIG. 6). In this position, as is shown in FIG. 5, the parallelogram rod assembly comprising retracting arm 12 and parallel arm 15 functions as a parallelogram linkage; and the opening edge of the dirt container 10 is aligned with and engages seal 9 on the edge of the dirt delivery opening.

During the lowering of the effective parallelogram rod assembly with auxiliary arm 18 latched, the mounting pivot 17 of the outer end of the parallel arm 15 performs an arc-like motion around the pivot 14 of the outer end of the retracting arm 12, counter-clockwise as shown in the figures, whereby during the lowering motion of retracting arm 12, the alignment of the dirt container 10 relative to a horizontal plane remains the same. This action was prevented, before the re-establishment of the engagement between the latch 30 and the protrusion 21 of the auxiliary link 18, by the action of the leaf spring 33 that rests on the protrusion 34 of the retracting arm 12. In this manner, the latch 30 and the protrusion 21 are engaged in a secure, rigid but releasable connection and thus the holding connection of the parallel arm 15 is also engaged with a fixed point on the machine. As soon as this holding connection is established and, therefore, the parallelogram rod assembly becomes effective, during further lowering, the pivot 17 of the outer end of the parallel arm 15 (See FIGS. 5 and 7) displaces itself counter-clockwise around the pivot 14 of the outer end of the retracting arm, whereby the leaf spring 33 is pressed more strongly against the protrusion 34 on the retracting arm 12, creating a greater restoring force. However, since the parallelogram rod assembly has a substantially higher resilience to deformation than does the leaf spring 33, the leaf spring is compressed accordingly so that the previously described support of the dirt container 10 by means of the leaf spring 33 is overcome or counter-acted, and the pivot 17 performs its displacement motion until the edge of the opening of the dirt container 10 rests firmly and tightly and seals against the seal 9 on the edge of the dirt penetration opening. Thus, the dirt container 10 returns to its operating position (seen in FIG. 8).

Figure 9:
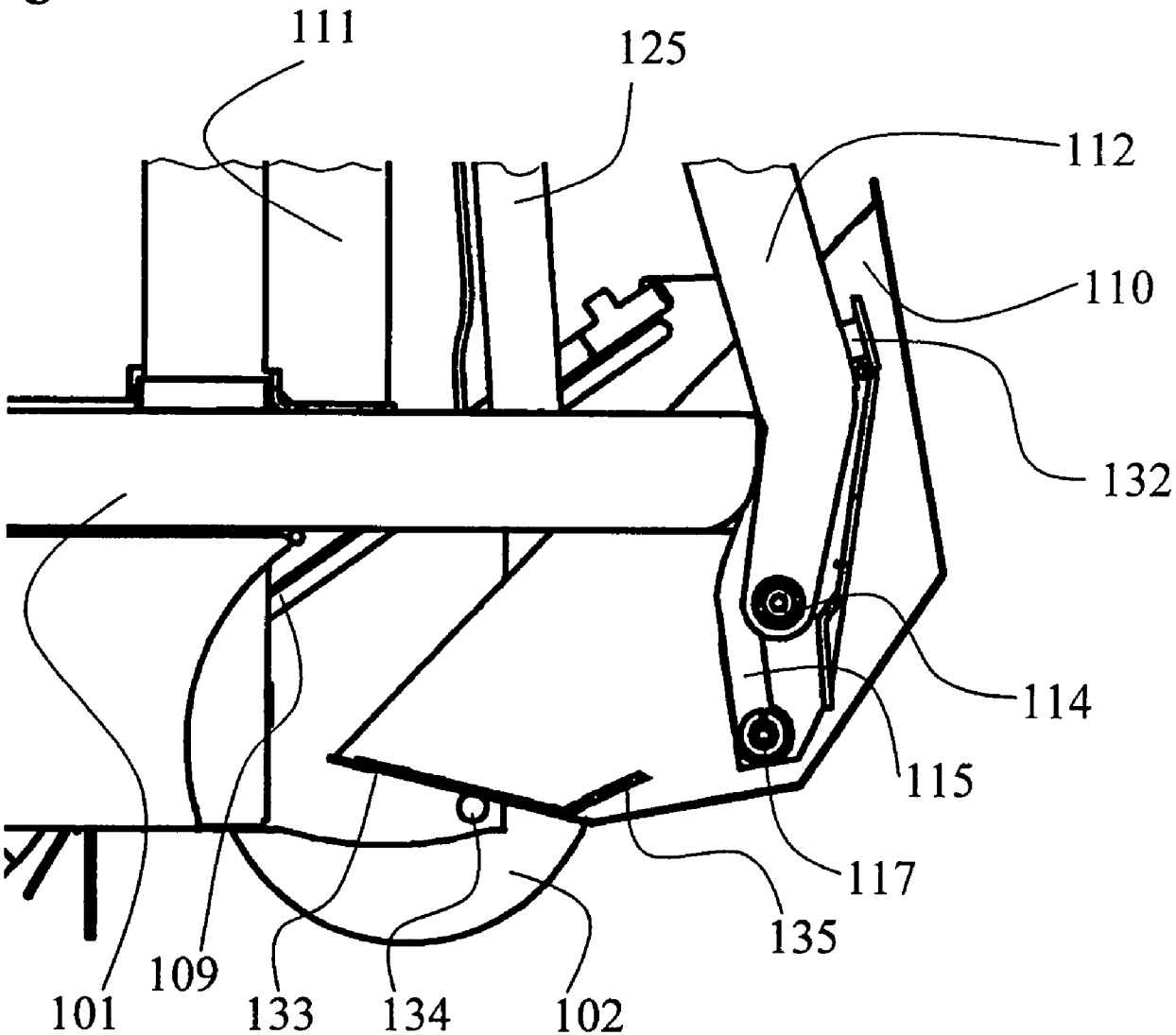
FIG. 9 is a fragmentary left side view of an alternate embodiment of the support of the dirt container during the lowering of the retracting arm with the retaining connection released.
Figure 10:
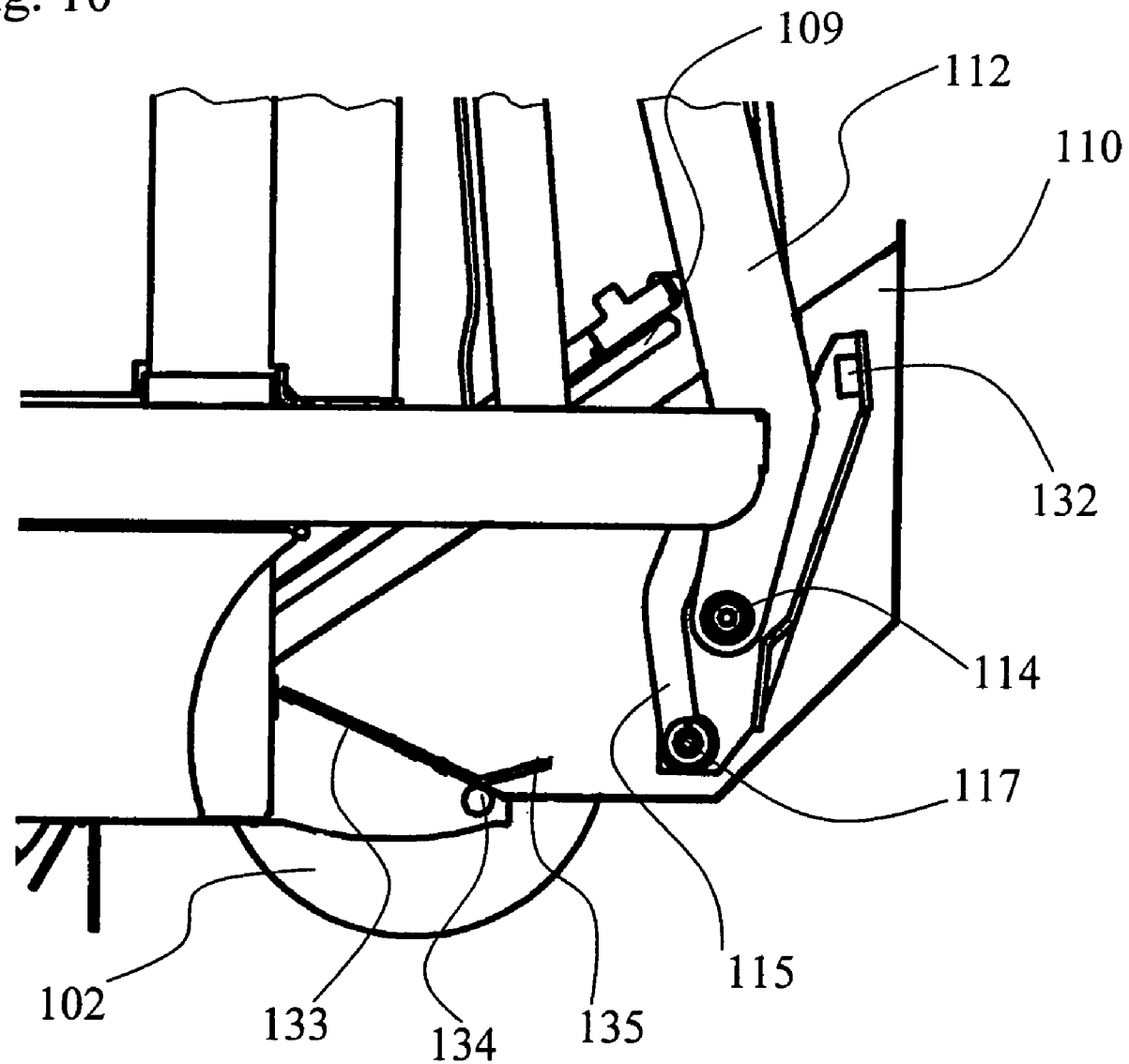
FIG. 10 is a view similar to FIG. 9 and shows the position of the dirt container of the machine with the retaining connection having just been re-established.
Figure 11:
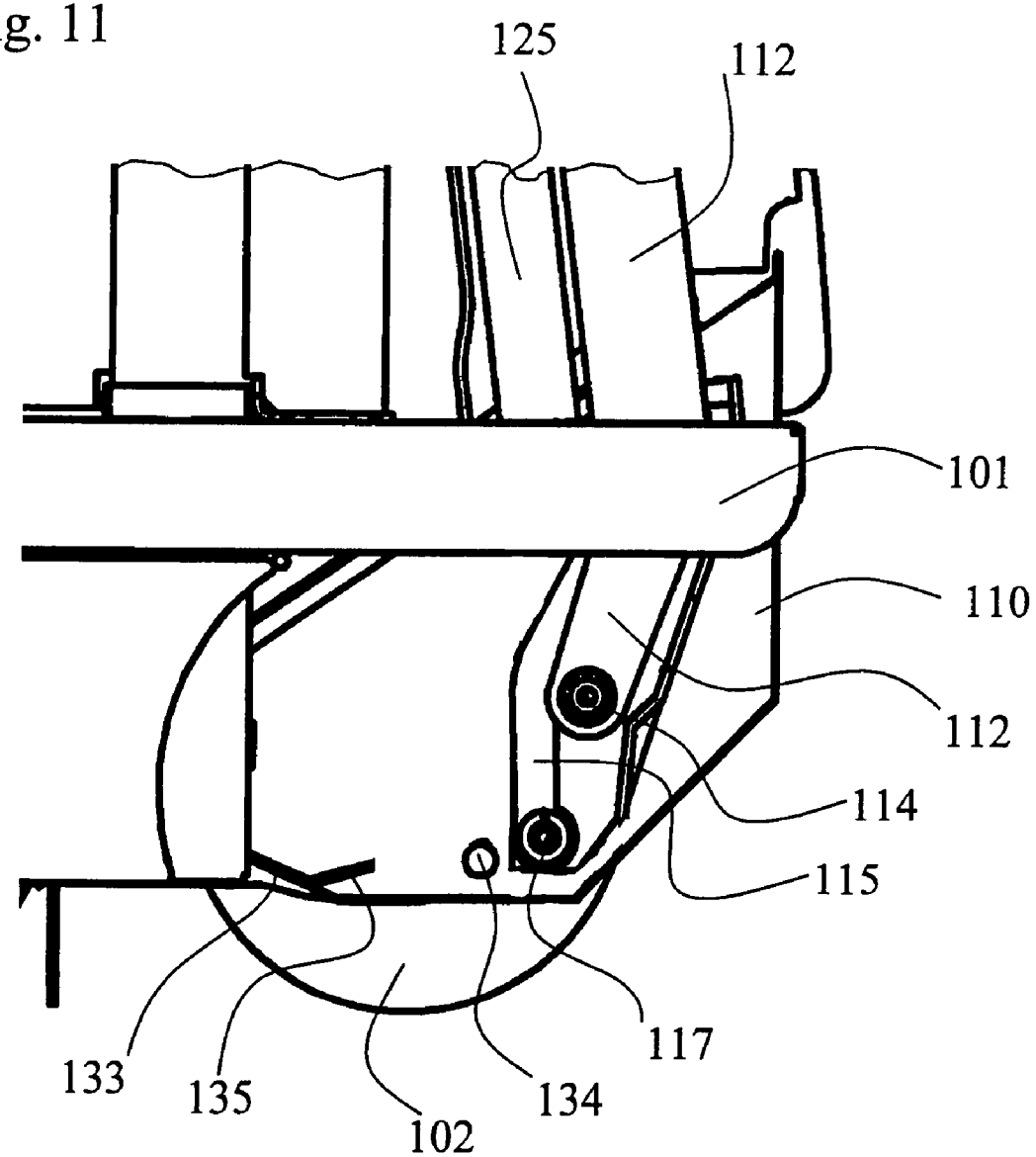
FIG. 11 is a view similar to FIG. 9 with the dirt container of the machine in its normal operating position in sealing engagement with the dirt discharge opening of the machine.

FIGS. 9 to 11 show, in fragmentary views, an alternate design of the support of the dirt container 10, where the same reference numbers (increased by 100) are used for the same and functionally corresponding elements as they are in FIGS. 1 to 8. The previously described elements need not be described again because it is not required in order to facilitate a full understanding of the invention by those skilled in the art.

Figure 4:
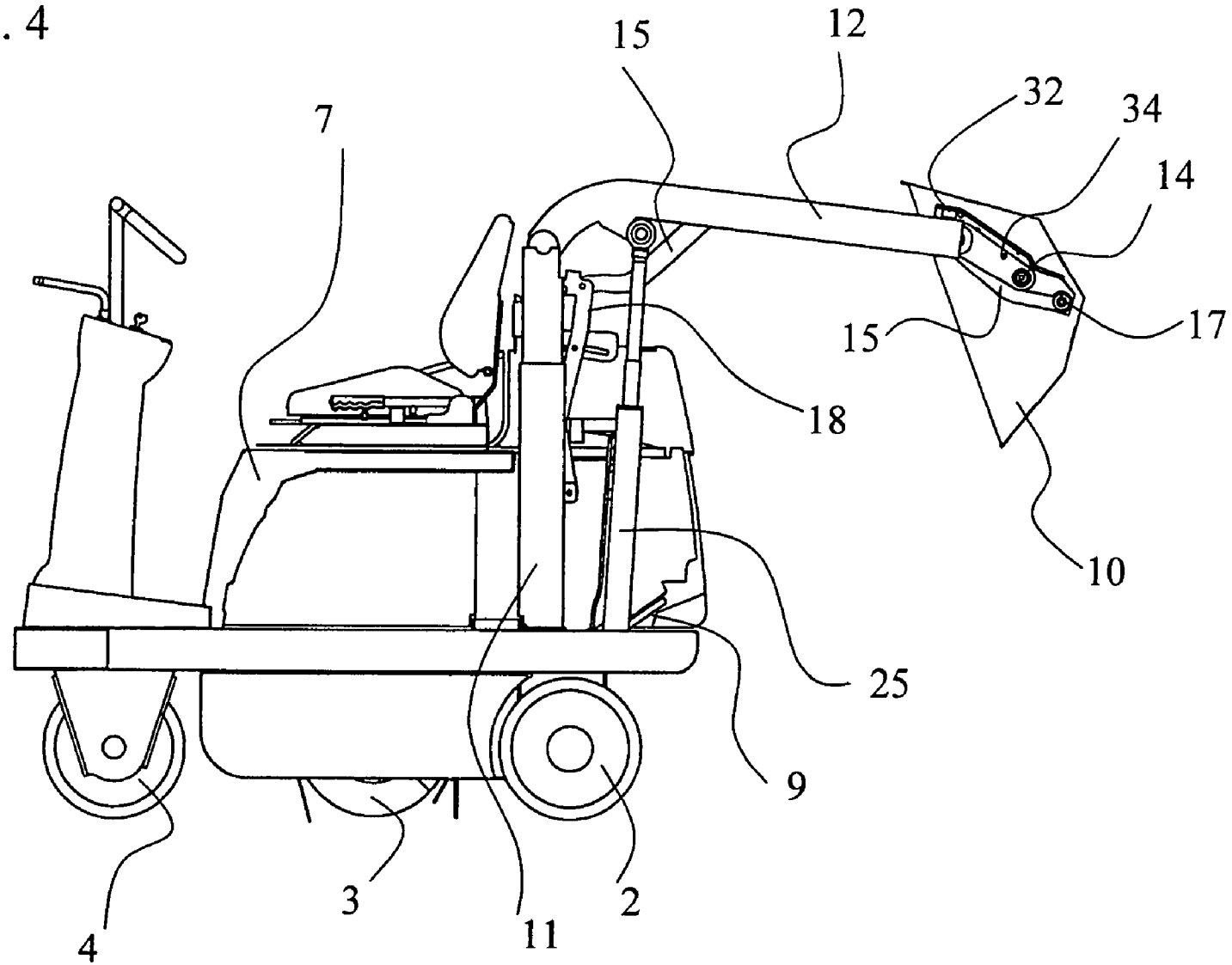
FIG. 4 is a left side view of the floor-cleaning machine of FIG. 1 with the dirt container in an emptying position and with the retracting arm lowered relative to FIG. 3.

As seen in FIGS. 9 to 11, the dirt container 110 comprises on its shown side wall (and also on the far side wall) a first guide surface 133 in the form of a laterally extending flange that serves to support the dirt container during the process of its lowering from its position as shown in FIG. 4 by means of a solid protrusion 134 firmly mounted on the machine frame or chassis. When the protrusion 135 rests against the left end of the first guide surface 133 (See FIG. 9), it prevents—in a manner described in connection with the leaf spring 33 in the example design of FIGS. 1 to 8—the pivot 117 of the outer end of the parallel arm 114 from rotating counterclockwise around the pivot 114 of the outer end of the retracting arm 112, whereby—as has also been described in the context of the example design according to FIGS. 1 to 8, the proximal end of the parallel arm 115 is conducted into its locked or retained position.

During this displacement motion, the first guiding surface 133 slides over the protrusion 134 until the locking position of the parallel arm 115 is reached. This is the case, when—as indicated in FIG. 10—the protrusion 134 has reached the rear or the right end of the first guiding surface 133. Since, as has also been previously described, for the parallelogram rod assembly to now be effective, the pivot 117 of the distal end of the parallel arm 115 must be displaced, counterclockwise, around the axis of pivot 114 of the distal end of the retracting arm 112, during the continued lowering motion by the hydraulic cylinder, the protrusion 134 is released from the first guiding surface 133. It engages and rides along a second guiding surface 135 inclined transversely to the rear and slightly upwards in FIG. 10. This serves the purpose of securing the container 110 from releasing abruptly in a counter-clockwise motion, and prevents the dirt container 110 from overshooting its alignment position due to the sudden release of the protrusion 134 from the first guiding surface 133.

Thus, the second guiding surface 135 does not prevent the pivot 117 from rotating slightly, counter-clockwise, around the mounting point 114. The continuing lowering motion of the dirt container 110 also releases the protrusion 134 from the second guiding surface 135, and the aligned dirt container 110 is moved into its operation position, i.e., into a sealing connection with the sea 109 on the edge of the dirt penetration opening.

I claim:

1. In a floor-cleaning machine including a cleaning element for removing dirt from the floor and delivering the removed dirt to a dirt container, the combination comprising:

a retracting arm pivotally mounted at a proximal end to said machine and pivotally mounted at a distal position to said dirt container;

a power actuator arranged to raise and lower said retracting arm;

an articulating linkage comprising a parallel arm and an auxiliary arm pivotally connected together, one end of said parallel arm pivotally connected to said dirt container and a first end of said auxiliary arm pivotally connected to said machine; and a latch mechanism releasable by an operator of said machine for selectively securing said auxiliary arm of said articulated linkage to said machine and for releasing said auxiliary arm to release said parallel arm and permit said parallel arm to move with said dirt container in a dumping action;

whereby when said auxiliary arm is secured to said machine by said latch mechanism, said retracting arm and said parallel arm of said articulating linkage act to maintain said dirt container in substantially the same orientation relative to a horizontal plane as said power actuator is extended and retracted over a range to raise and lower said dirt container between a dumping position and a use position; and when said auxiliary arm is not secured to said machine by said latch mechanism, said auxiliary arm is released, thereby to permit said dirt container to rotate about a horizontal axis to dump the contents thereof.

2. The machine of claim 1 characterized in that when said latch mechanism is released to permit said parallel arm to translate relative to said retracting arm to place said container in a dumping position. and said power actuator is retracted, said auxiliary arm guides a second opposing end of said parallel arm toward said latch mechanism until said auxiliary arm is secured to said machine by said latch mechanism, and said auxiliary arm is free to pivot about said second end thereof when secured to said machine.

3. The machine of claim 2 further including a curved guide slot on said machine; and a guide member fixed to said auxiliary arm of said articulating linkage and received in said guide slot for guiding said auxiliary arm between the latched position and a dumping position for said container.

4. The machine of claim 2 further comprising:

a spring extending between said dirt container and said retracting arm to bias said dirt container to rotate in a direction to restore said dirt container from a dumping position to an upright position.

5. The machine of claim 4 further comprising:

a stop limit member on said dirt container adapted to engage said retracting arm to limit the rotation of said dirt container in a dumping mode, and cooperating with the retraction of said power actuator to force said articulating linkage to the use position and thereby secure said auxiliary arm to said latch mechanism.

6. The machine of claim 2 wherein said latch mechanism includes a moveable latch member having a cam surface slidably mounted to said machine and a protrusion on said auxiliary arm, constructed and arranged such that when said articulated linkage is folded to a normal use position, said protrusion rides over said cam surface and displaces said latch member and is secured to said machine thereby.

7. The machine of claim 6 further comprising:

a cable actuatable by the operator occupying a driver's position on said machine to force said latch member to a release position against a restoring force to release said articulating linkage, thereby to permit said dirt container to rotate to dump the contents thereof when said dirt container is raised to a dumping position.

8. The machine of claim 6 characterized in that when said articulating linkage is secured to said machine by said latch mechanism and said power actuator is actuated to lower said dirt container from a dumping position, said retracting arm and said parallel arm cooperate to act as a parallelogram linkage to return said dirt container to a sealing engagement with a dirt discharge opening of said machine to receive dirt and debris.

9. The machine of claim 6 wherein said power actuator is a hydraulic cylinder having a butt end pivotally mounted to said machine and a rod end pivotally connected to said retracting arm.

10. The machine of claim 1 further comprising:

a fixed stop member on one of said retracting arm and said dirt container to limit the pivoting motion therebetween;

a first guide surface adjacent a forward wall of said dirt container; and a second fixed stop member on said machine for engaging said guide surface of said dirt container for guiding said dirt container into sealing engagement with a dirt discharge opening of said machine when said power actuator lowers said retracting arm to the use position.

11. The machine of claim 10 further a second guide surface extending from an end point of said first guide surface on said dirt container and extending at an angle therefrom to permit tilting of said dirt container to accommodate a final sealing engagement with said dirt delivery opening in the use position.

12. In a floor-cleaning machine including a cleaning element for removing dirt from the floor and delivering the removed dirt to a dirt container:

a retracting arm pivotally mounted at a proximal position to said machine and pivotally mounted at a distal position to said dirt container to move said dirt container between a use position and a dumping position;

a power actuator arranged to raise and lower said retracting arm;

a parallel arm connected at a distal end to said dirt container and having a proximal end;

a latch mechanism releasable by an operator of said machine for selectively releasably securing said proximal end of said parallel arm to said machine while permitting said parallel arm to pivot, or releasing said parallel arm to permit said proximal end of said parallel arm to move away from said machine to tilt said container to a dumping position; and a guide member to guide said proximal end of said parallel arm to said latch mechanism when said container is lowered to a use position;

whereby when said parallel arm is secured to said machine by said latch mechanism, said parallel arm acts to maintain said dirt container in substantially the same orientation relative to a horizontal plane as said power actuator is extended and retracted over a range to raise and lower said dirt container; and when said parallel arm is not secured to said machine by said latch mechanism, said retracting arm is in a raised position for dumping, said dirt container is free to rotate under the weight of its contents to dump the contents, and when said dirt container is thereafter lowered to the use position, said guide member guides said proximal end of said parallel arm to be secured by said latch mechanism.

13. The machine of claim 12 wherein said latch mechanism includes an auxiliary arm having one end pivotally connected to said proximal end of said parallel arm and a second end pivotally connected to said machine, said auxiliary arm and said parallel arm forming an articulating link, said latch mechanism further including a latch member actuatable by an operator to selectively secure auxiliary arm in a fixed position or to release said auxiliary arm to permit it to rotate and thereby allow said parallel arm to move relative to said machine and permit said container to rotate to dump its contents, said latch mechanism securing said container when said retracting arm is lowered to the use position.

* * * * *